US006726307B2

(12) United States Patent
Feiner

(10) Patent No.: US 6,726,307 B2
(45) Date of Patent: Apr. 27, 2004

(54) APPARATUS AND METHOD FOR PROTECTING PRINTING HEADS

(75) Inventor: David Feiner, Ra'anana (IL)

(73) Assignee: Aprion Digital Ltd., Netanya (IL)

( * ) Notice: Subject to any disclaimer, the term of this patent is extended or adjusted under 35 U.S.C. 154(b) by 0 days.

(21) Appl. No.: 09/982,985

(22) Filed: Oct. 22, 2001

(65) Prior Publication Data

US 2002/0070996 A1 Jun. 13, 2002

Related U.S. Application Data

(60) Provisional application No. 60/242,141, filed on Oct. 23, 2000.

(51) Int. Cl.[7] ..... B41J 23/00
(52) U.S. Cl. ..... 347/37
(58) Field of Search ..... 347/37, 5, 94, 347/50

(56) References Cited

U.S. PATENT DOCUMENTS 5,245,361 A * 9/1993 Kashimura et al. ..... 347/50
5,367,328 A 11/1994 Erickson
5,719,608 A 2/1998 Sabonis et al.
6,007,190 A 12/1999 Murray et al.
6,068,370 A * 5/2000 Miller et al. ..... 347/85

* cited by examiner

*Primary Examiner*—Michael Nghiem
(74) *Attorney, Agent, or Firm*—Eitan, Pearl, Latzer & Cohen Zedek, LLP

(57) ABSTRACT

Apparatus and method for protecting print heads from uncontrolled movement and vibration is provided. The apparatus includes at least one print head, a movable component attachable to a flexible cable carrier, the flexible cable carrier being coupled to at least one print head, and an isolating component attachable to the movable component, for isolating uncontrolled movement and vibration of the flexible cable carrier from the at least one print head.

8 Claims, 2 Drawing Sheets

APPARATUS AND METHOD FOR PROTECTING PRINTING HEADS

CROSS-REFERENCE TO RELATED APPLICATIONS

The present application claims priority from U.S. provisional application Ser. No. 60/242,141, filed Oct. 23, 2000.

FIELD OF THE INVENTION

The present invention is generally related to apparatus for protecting a print head from a flexible cable carrier with which it is coupled and in particular is related to apparatus for protecting ink-jet printing heads.

BACKGROUND OF THE INVENTION

During printing, for example ink jet printing, the print array heads may be moved along one or more axes to print on to the substrate. Ink is generally supplied to the print heads by an ink delivery system. As the print heads moves, the ink delivery system attached to the print heads travels with the print heads. The ink delivery system may include tubing and hoses for supplying the ink. In addition, the printing system includes cables for data transfer and control information as well as electricity supply cables. Commonly, the tubing, hoses and cables associated with the printing system are enclosed within a cable carrier, which is rigidly attached to the print heads that they move together with the movement of the print heads.

Reference is now made to FIG. 1, which illustrates the print head 12 and cable carrier 14 of a printing system. The cable carrier 14 is rigidly attached to the print head 12 by a plate 16 configured to allow the ink supply tubing and data and electronic cables to pass through to the cable carrier 14. The cable carrier 14 is generally flexible and travels along a support structure 18. The print head 12 is configured to travel on linear bearings 20 by a linear motor (not shown) along the "Y"-axis. As the print head 12 moves along the "Y"-axis, the cable carrier 14 rotates as indicated by arrow 22.

The height of the print head above the substrate may be as small as 2 mm. The weight of the tubing, hoses and cables is generally relatively heavy and causes vibration. Any vibration of the ink delivery system owing to the weight and movement of the tubing and cables, for example, will cause the print head to vibrate because of the rigidity of the attachment between the ink delivery system and the print heads. The vibration may lead to inaccurate, uneven and poor quality printing results.

It would be advantageous to provide an apparatus that overcomes the disadvantages of the prior art.

SUMMARY OF THE INVENTION

Apparatus and method for protecting print heads from unwanted movement and vibration is provided. The apparatus includes at least one print head, a movable component attachable to a flexible cable carrier, the flexible cable carrier being coupled to at least one print head, and an isolating component attachable to the movable component, for isolating uncontrolled movement and vibration of the flexible cable carrier from the at least one print head.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
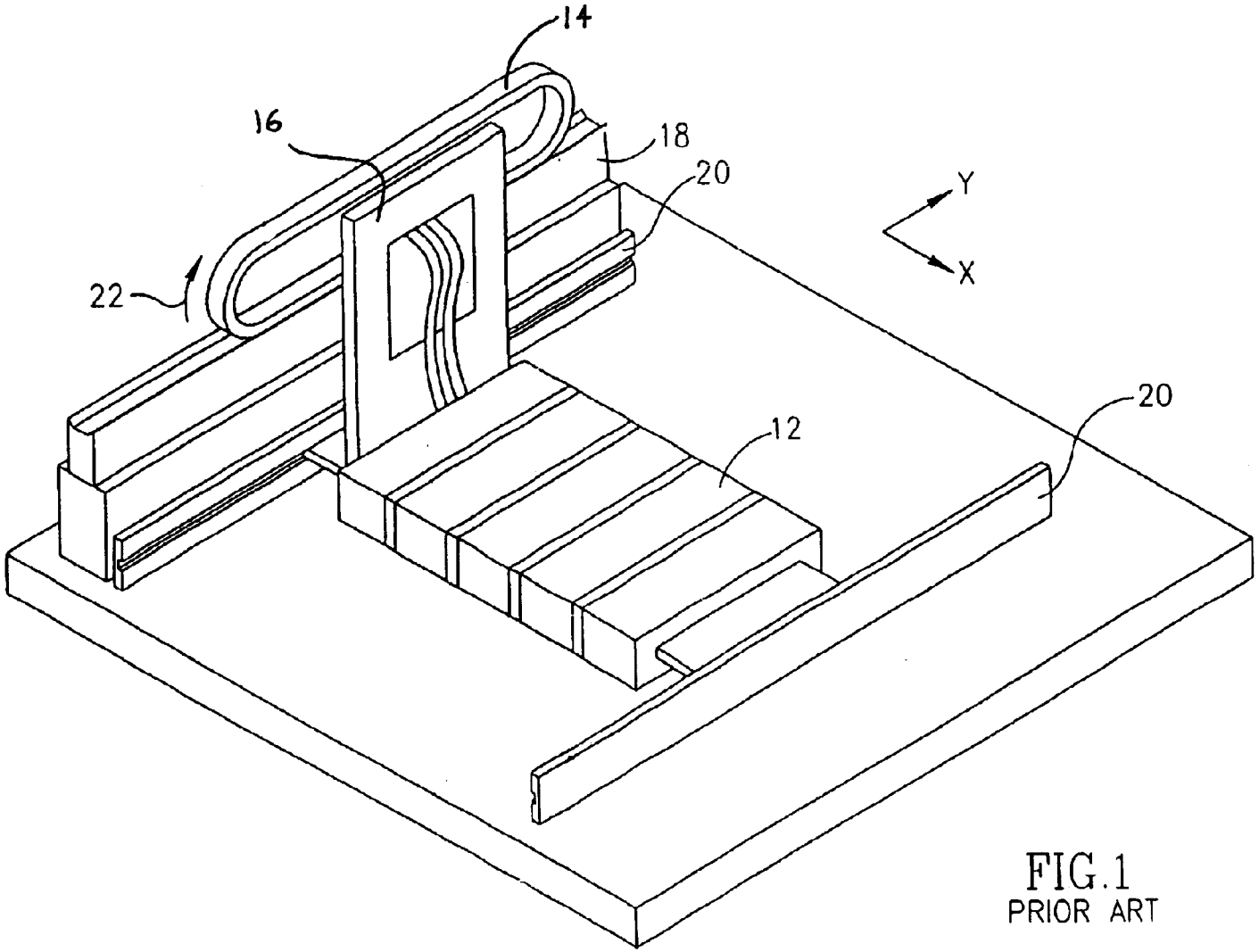
FIG. 1 PRIOR ART
FIG. 1 is an illusion of the print-head and cable carrier of a prior art printing system.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Figure 2:
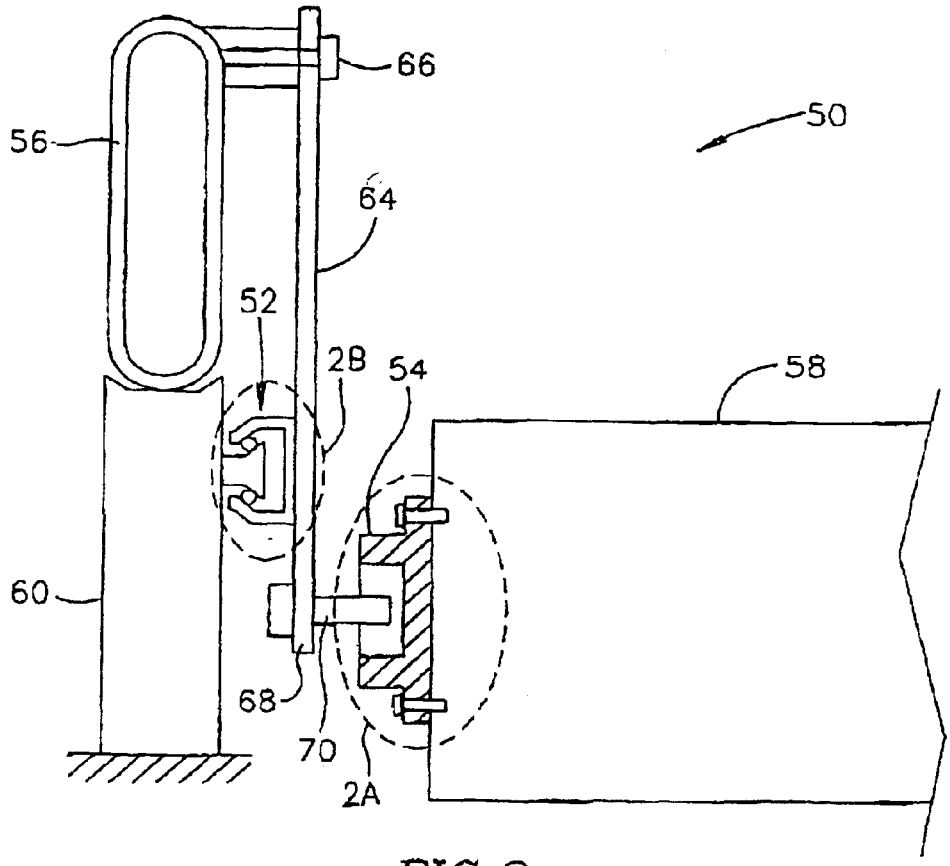
FIG. 2 is a sectional elevation illustration of a print-bead protecting apparatus constructed and operative according to some embodiments of the present invention.
Figure 2A:
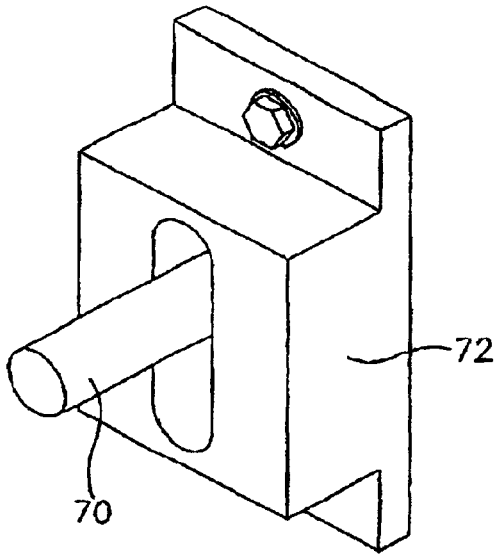
FIGS. 2A and 2B are enlarged sectional details of the print-head protecting apparatus.
Figure 2B:
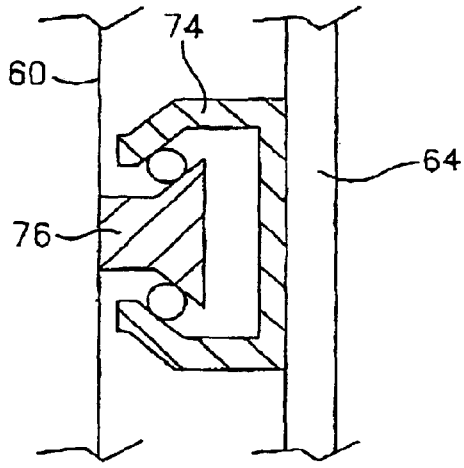

Reference is now made to FIGS. 2, 2A and 2B. FIG. 2 is a sectional elevation illustration of a print head protecting system, generally designated 50, constructed and operative according to some embodiments of the present invention. FIGS. 2A and 2B are enlarged sectional details of part of the print bead protecting apparatus 50.

For exemplary purposes only, the print head protecting apparatus 50 is described with reference to protecting ink jet printing heads from uncontrolled movement and vibration, but, as will be appreciated by those skilled in the art the apparatus is not limited thereto.

The print head protecting apparatus 50 comprises a linear bearing component 52 (FIG. 2B) and a pin connection component 54 (FIG. 2A) which isolate the unwanted movement and vibration of the cable carrier 56 from the print head 58 to which a flexible cable carrier 56 is coupled. Linear bearing component 52 and pin connection component 54 prevent vibration being transferred from flexible cable carrier 56 to the print head 58.

Flexible cable carrier 56 may be any suitable cable carrier, such as the cable carrier system supplied by Igus Inc of E. Providence, Richmond, USA. The flexible cable carrier protects and supports the supply hoses. The flexible cable carrier 56 may be similar to cable carrier 14 of FIG. 1.

The print head protecting apparatus 50 may be part of a ping system, such as a ink-jet printing machine. The print head protecting apparatus 50 also comprises a cable carrier support 60, which supports the cable carrier and is configured to allow the flexible cable carrier 56 to travel along the cable carrier support 60 in the Y-axis in parallel to and together with the movement of the print head 58.

One end 66 of a plate 64 (which may be metal) is suitable attached to cable carrier 56. At the other end 68 of plate 64, a pin 70 is suitable attached. Pin 70 protrudes from the plate 64. Pin connection component 54 comprises a receiver 72, which is suitably attached to print head 58. Receiver 72 is configured to receive pin 70 within an elliptical opening formed therein sad allow the pin 70 freedom of movement along all axes including the "Z"-axis.

In an alternative embodiment, pin 70 may be suitably ached to print head 58 and receiver 72 may be suitably attached to plate 64.

Linear beating component 52 may be a linear bearing track known in the art, which comprises a generally "U"-channel 74 suitably attached to plate 64 and a track 76 suitably attached to cable carrier support 60. Channel 74 moves along the longitudinal axis of the linear bearing component 52.

In practice, as the print bead 58 moves along the "Y"-axis, pin 70 is moved along with it. "U"-channel 74, which is attached to plate 64, also moves along the "Y"-axis on the linear bearing track 76. The cable carrier 56 is rotated and also effectively moves along the cable carrier support 60 in parallel with the print head 58.

The two components of the print head protecting apparatus 50 (linear bearing component 52 and pin connection component 54) provide protection at two levels. Any vibration or sudden movement of the cable carrier 56 is transferred to the plate 64. At a first level, the linear bearing track 76 of the linear bearing component 52 absorbs at least part of the energy being transferred. Secondly, if there is any continuing vibration, which travels down to pin 70, the receiver 72 allows the pin 70 to vibrate within certain limits without directly affecting the print head itself. In a further embodiment, a rubber or silicone protector may be inserted within receiver 72 to provide yet further absorption of any sundry vibration.

Thus, linear bearing component 52 and pin connection component 54 prevent vibration being transferred from the flexible cable carrier 56 to the print head 58.

The apparatus 50 is described with reference to protecting ink jet printing heads, but, as will be appreciated by those skilled in the a the apparatus is not limited to ink jet printing heads. For example, it will be appreciated by those skilled in the art that the apparatus is also suitable for other fields, besides printing, which require the movement of two devices which need to be connected for movement in parallel while at the same time requiring an isolating of one device from the second.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. An apparatus comprising;

a print head;

a movable component attached to a flexible cable carrier, said movable component being coupled to said print head; and an isolating component to isolate uncontrolled movement and vibration of said flexible cable carrier from said at least one print head, wherein said isolating component comprises a linear bearing track attached to a cable carrier support and a generally U-shaped channel attached to maid movable component.

2. The apparatus according to claim 1, wherein said movable component comprises a pin, and wherein a receiver is attached to said print head, said receiver being configured to receive said pin and allow said pin freedom of movement in at least one direction.

3. The apparatus according to claim 2, wherein said receiver comprises a rubber protector.

4. The apparatus according to claim 2, wherein said receiver comprises a silicone protector.

5. The apparatus according to claim 1, wherein said movable component comprises a receiver, and wherein a pin is attached to said print head, said receiver being configured to receive said pin and allow said pin freedom of movement in at least one direction.

6. The apparatus according to claim 5, wherein said receiver comprises a rubber protector.

7. The apparatus according to claim 5, wherein said receiver comprises a silicone protector.

8. A method for isolating uncontrolled movement and vibration of a print head from a flexible cable carrier, said method comprising:

attaching a first end of a movable component to said flexible cable carrier;

attaching an isolating component to said movable component;

attaching a pin to a second end of said movable component, said second end being distal from amid first end; and attaching a receiver to said print head, said receiver being configured to receive said pin and allow said pin freedom of movement in one direction.

* * * * *